US005302464A

United States Patent [19]

Nomura et al.

[11] Patent Number: 5,302,464

[45] Date of Patent: Apr. 12, 1994

[54] METHOD OF PLATING A BONDED MAGNET AND A BONDED MAGNET CARRYING A METAL COATING

[75] Inventors: Takuji Nomura, Otsu; Hiroshi Watanabe, Sagamihara, both of Japan

[73] Assignee: Kanegafuchi Kagaku Kogyo Kabushiki Kaisha, Osaka, Japan

[21] Appl. No.: 845,645

[22] Filed: Mar. 4, 1992

[30] Foreign Application Priority Data

| | | | |
|---|---|---|---|
| Mar. 4, 1991 | [JP] | Japan | 3-63976 |
| Mar. 4, 1991 | [JP] | Japan | 3-63977 |
| Mar. 4, 1991 | [JP] | Japan | 3-63978 |
| Mar. 4, 1991 | [JP] | Japan | 3-63979 |

[51] Int. Cl.[5] ..... C23C 28/00

[52] U.S. Cl. ..... 428/551; 205/183; 205/119; 205/271; 205/280; 428/556; 428/565

[58] Field of Search ..... 205/119, 122, 271, 280, 205/183; 148/302; 428/611

[56] References Cited

U.S. PATENT DOCUMENTS

| | | | |
|---|---|---|---|
| 4,036,709 | 7/1977 | Harbulak | 205/280 |
| 4,244,790 | 1/1981 | Wieczerniak | 204/49 |
| 4,942,098 | 7/1990 | Hamamura et al. | 428/555 |
| 5,013,411 | 5/1991 | Minowa et al. | 205/119 |

FOREIGN PATENT DOCUMENTS

| | | |
|---|---|---|
| 0248665 | 12/1987 | European Pat. Off. . |
| 1-105502 | 4/1989 | Japan . |
| 2-23603 | 1/1990 | Japan . |
| 2-31401 | 2/1990 | Japan . |
| 2-42708 | 2/1990 | Japan . |
| 2-43395 | 2/1990 | Japan . |
| 3-11704 | 1/1991 | Japan . |
| 3-11714 | 1/1991 | Japan . |
| 3-116703 | 5/1991 | Japan . |
| 3-123009 | 5/1991 | Japan . |
| 1205503 | 8/1991 | Japan . |
| 3-74012 | 11/1991 | Japan . |

OTHER PUBLICATIONS

Chemical Abstracts 110:123875m Apr. 3, 1989.

Patent Abstracts of Japan, vol. 13, No. 246 (E-769) (3594) Jun. 8, 1989 of JP-A-10 48 404 (Seiko Epson) Feb. 22, 1989.

*Primary Examiner*—John Niebling

*Assistant Examiner*—Edna Wong

*Attorney, Agent, or Firm*—Armstrong, Westerman, Hattori, McLeland & Naughton

[57] ABSTRACT

A closely adherent metal coating having a uniform thickness and substantially free from pinholes is formed on the porous surface of a bonded magnet to improve its oxidation and corrosion resistance without lowering its magnetic properties. The coating is formed by electroplating from an aqueous solution not containing chlorine, and having a pH of 5 or above. More particularly, the solution contains mainly nickel sulfate, an electrolyte in the form of an organic acid salt not containing chlorine, and a basic electrolyte not containing chlorine, and forms a nickel coating on the magnet surface.

10 Claims, 5 Drawing Sheets

METHOD OF PLATING A BONDED MAGNET AND A BONDED MAGNET CARRYING A METAL COATING

BACKGROUND OF THE INVENTION

1. Field of the Invention

This invention relates to a method of plating a bonded magnet, and to a bonded magnet carrying a metal coating thereon More particularly, it relates to a method of plating a bonded magnet with a metal coating which is good adhesion has uniform in thickness, has few pinholes, and imparts oxidation and corrosion resistance to the magnet without lowering its magnetic properties, and to a bonded magnet carrying a metal coating of high corrosion resistance on its surface.

2. Description of the Prior Art

Magnets can be broadly classified by their manufacturing process as sintered, cast and bonded magnets, and by their material as alloy magnets made of alloys such as Alnico, Sm-Co and Nd-Fe-B alloys, and oxide magnets made of e.g. ferrites. The sintered magnet is made by compressing a magnetic powder at a high temperature, and the cast magnet by casting a molten metal into a mold. The bonded magnet is made by e.g. the injection, extrusion or compression molding of a mixture of a magnetic powder and a synthetic resin as a binder.

The bonded magnets can be made easily in a wide variety of desired shapes and are, therefore, used for making a wide variety of electrical and machanical parts. They are, however, porous and are, therefore, low in corrosion resistance. After a long time of use, they are likely to have their surface and internal portions oxidized or otherwise corroded, and greatly lower their magnetic properties. It is, therefore, necessary to coat the surface of the bonded magnet in some way or other without lowering its magnetic properties. The bonded magnet is also low at mechanical strength and necessitates the coating of its surface so as not to crack or chip easily. The coating of its surface contributes also to giving it a pleasant or beautiful appearance.

The bonded magnets made of alloys consisting mainly of rare-earth and transition metals (hereinafter referred to as "bonded rare-earth magnets") are used for a particularly wide range of applications owing to their superiority in magnetic properties to the ferrite or Alnico magnets. They have, however, the drawback of being easily oxidized. This is particularly the case with the Nd-Fe-B alloy magnets. The bonded rare-earth magnets undergo a great reduction in magnetic properties as a result of oxidation when used in a highly humid environment, and essentially call for the coating of their surfaces.

Plating is a well-known method which is often used for coating a surface with a metal. There are a variety of methods including vapor deposition, hot dipping, electroless plating, electroplating and substitution plating. Electroless plating has the advantages of being capable of forming a coating having a uniform thickness, coating even the inner surfaces of pores, and being carried out at a low cost by using a simple and inexpensive apparatus. Electroplating has the advantages of being able to form a very adherent coating rapidly at a low cost. Nickel electroplating is particularly beneficial from the standpoints of corrosion resistance and industrial utility.

It is, however, difficult to achieve the desired oxidation and corrosion resistance of a bonded magnet by employing any conventional process for electroless plating or electroplating. Although we, the inventors of this invention, ascertained that the electroplating of a bonded magnet could improve its corrosion resistance to some extent (Japanese Patent Application Laid-Open No. 11704/1991), its corrosion resistance has still been unsatisfactory for any use thereof under harsh conditions, as when it is used for a motor in an automobile.

We made a careful examination of the conventionally electroplated surfaces of bonded magnets, and found that the metal coatings had a by far larger number of pinholes than was macroscopically presumable, and that their corrosion started for the most part in or near the pinholes.

We have studied the reason why such a large number of pinholes are formed in the metal coating on the surface of the bonded magnet. The bonded magnet comprises a magnetic powder and a synthetic resin as a binder, as hereinabove stated, and both the magnetic powder and the synthetic resin are, therefore, exposed in the surface of the magnet. If the magnet is electroplated, the metal used for plating it is first deposited on the exposed magnetic powder, and as the deposited metal grows, it gradually covers the synthetic resin, which is not an electric conductor, until it finally covers the whole surface of the magnet. It is obvious from this process of deposition that the deposited metal forms a coating having a smaller thickness on the exposed synthetic resin than on the magnetic powder. Accordingly, pinholes are more likely to form in the coating on the exposed synthetic resin which is relatively far from the exposed magnetic powder. This is a phenomenon which is peculiar to the bonded magnet, and is apparently due to the difference in electrical resistance from one portion of its surface to another.

The bonded magnet having, for example, a nickel coating formed on its surface by ordinary electroplating is inferior in corrosion resistance to other materials that have likewise been plated. This is due to the fact that the nickel or ammonium chloride, or other chloride that the aqueous solution used for plating contains as the electrolyte penetrates the bonded magnet through its porous surface during its plating, stays in the interface between the magnet and the coating formed thereon, and eventually forms rust, etc. in their interface and the interior of the magnet.

The chloride which the aqueous solution for nickel plating contains promotes the surface activation of the anode and thereby the dissolution of nickel from the anode into the solution, and the removal of the chloride therefrom brings about a great reduction in plating efficiency. Although the application of a high voltage may enable nickel plating in a solution not containing any chloride, the flow of a high electric current to the surface of the material to be plated as a result of its contact with the cathode causes not only the seizure thereof and the formation of a metal coating not having a uniform thickness, but also the heavy polarization of the anode which results in an unstable plating operation. This is particularly the case with a material having a volume resistivity in excess of about $10^{-3}$ ohm-cm, such as a bonded magnet.

Japanese Patent Application Laid-Open No. 42708/1990 discloses an electroplating process which employs an electrolyte composed of an organic solvent and not containing chlorine, as means for overcoming the above problems. The non-aqueous wet plating process which employs an organic solvent has, however, the drawback of being expensive, since the solution which it employs is expensive, and since the apparatus which it employs is complicated and expensive. Thus, there has been a strong desire for a process which employs an aqueous solution and can form a metal coating of good corrosion resistance on the surface of a bonded magnet.

Although electroless plating can be employed for forming a metal coating on the surface of a bonded magnet, it is still difficult to obtain any satisfactory corrosion resistance. This is particularly the case with a bonded magnet made by compression molding which contains a small proportion of a synthetic resin as a binder. It is assumed that an electroless plating solution penetrates a bonded magnet through its porous surface and partly remains in the plated magnet, and that if the solution is acidic or contains chlorine, it corrodes the plated magnet.

When a bonded magnet is plated, it is necessary for its surface to be clean and active, whichever method may be employed for plating it. If its surface is not clean or active, the metal with which it is to be plated fails to adhere closely to its surface. The bonded magnet, however, cannot be said to have a surface which is good for plating, since the oxidation of its surface by heating, the adherence of the binder resin, or a mold release agent to its surface, etc. occur during its manufacture. It is, therefore, usual to cleanse its surface with a strong acid, such as chromic or sulfuric acid, before it is plated. This treatment is, however, not good for, among others, a bonded alloy magnet. The acid not only dissolves and oxidizes the magnetic alloy on its surface and lowers its magnetic properties, but also penetrates the porous surface and interior of the magnet and partly remains in the plated magnet. The remaining acid is very likely to corrode the magnet and impair the adherence of a metal coating to it.

SUMMARY OF THE INVENTION

A bonded magnet is generally a molded product of a mixture of a magnetic powder and a synthetic resin as a binder, and is called a bonded rare-earth magnet if the magnetic powder is of an alloy represented as R-T-B, where R stands for Nd, or a mixture of Nd and another rare-earth element, and T stands for Fe, or a mixture of Fe and a transition element. The synthetic resin used as the binder is selected from among thermoplastic or thermosetting resins, or rubbers, depending on the molding process which is employed. Examples of the thermosetting resins which are employed for the purpose of this invention are phenolic, epoxy and melamine resins, and examples of the thermoplastic resins are polyamides such as nylon 6 and nylon 12, polyolefins such as polyethylene and polypropylene, polyvinyl chloride, polyesters, and polyphenylene sulfide. An ultraviolet-curing resin can also be employed. Moreover, the use of a metal having a relatively low melting point as the binder falls within the scope of this invention, too.

The wet electroplating process can usually form a coating of a metal such as Zn, Sn, Cu, Ni, Co, Au, Ag or Pb. Zinc, tin or lead plating is satisfactory those applications in which the material which has been plated is protected against corrosion at the sacrifice of the coating formed thereon, as when it is a structural material, or member. The metal coating need, however, be covered with a resin, or inorganic material, if not only the material which has been plated, but also the coating formed thereon has to be protected against oxidation and corrosion, as when it is an electronic part, or component. The same is true of copper plating. A copper coating has the drawback of having black copper oxide or verdigris formed easily on its surface, though copper is a noble metal. Gold or silver plating is very effective for preventing corrosion, but is too expensive to be of great industrial use.

Therefore, nickel or cobalt, or nickel- or cobalt-alloy plating is definitely the most effective means for preventing corrosion, and is actually used for a wide variety of parts and materials. It is, however, difficult to obtain any satisfactory corrosion resistance by employing any conventional method for nickel plating, particularly on a material having a porous surface, such as a bonded magnet made by molding a mixture of a magnetic metal (or alloy) powder and a synthetic resin (or a low-melting metal) as a binder. No conventional wet electroplating process can form a nickel coating imparting satisfactory corrosion resistance to any such material.

It is a first object of this invention to provide a method of plating a bonded magnet with a coating which can protect it against corrosion, even if a plating solution may penetrate the magnet through its porous surface and stay therein. This object is attained by a method which comprises electroplating a bonded magnet in an aqueous solution consisting mainly of nickel sulfate, an electrolyte in the form of an organic acid salt not containing chlorine, and a basic electrolyte not containing chlorine, and having a pH (hydrogen ion concentration) of 5 or above to form a nickel coating on its surface.

It is a second object of this invention to provide a method of plating a bonded magnet which can clean and activate the surface of a bonded magnet without using any strong acid and thereby lowering its magnetic properties, and form a coating adhering closely to the magnet and protecting it against corrosion. This object is attained by a method which comprises barrel polishing a bonded magnet instead of cleansing it with any strong acid such as chromic or sulfuric acid, and electroplating it to form a metal coating on its surface.

It is a third object of this invention to provide a method of plating a bonded magnet which can prevent any plating solution from penetrating a bonded magnet through its porous surface, and make the whole surface thereof uniform in electrical resistance to restrain the formation of pinholes in a metal coating formed thereon. This object is attained by a method which comprises coating the surface of a bonded magnet with a mixture of a resin and a powder of an electrically conductive material, and electroplating the magnet to form a metal coating on its surface.

It is a fourth object of this invention to provide a method of plating a bonded magnet which can form a metal coating having few pinholes on a magnet surface which is uniform in electrical resistance. This object is attained by a method which comprises forming a metal coating by electroplating on the surface of a bonded magnet made by molding a magnetic powder with a mixture of a resin and a powder of an electrically conductive material, or a metal powder, as a binder.

According to a fifth aspect of this invention, there is provided a bonded magnet carrying a metal coating of improved oxidation and corrosion resistance. The metal coating is formed by any of the methods according to this invention as hereinabove set forth.

Other objects, features and advantages of this invention will become apparent from the following description, the appended claims and the accompanying drawings.

DETAILED DESCRIPTION OF THE INVENTION

Figure 1:
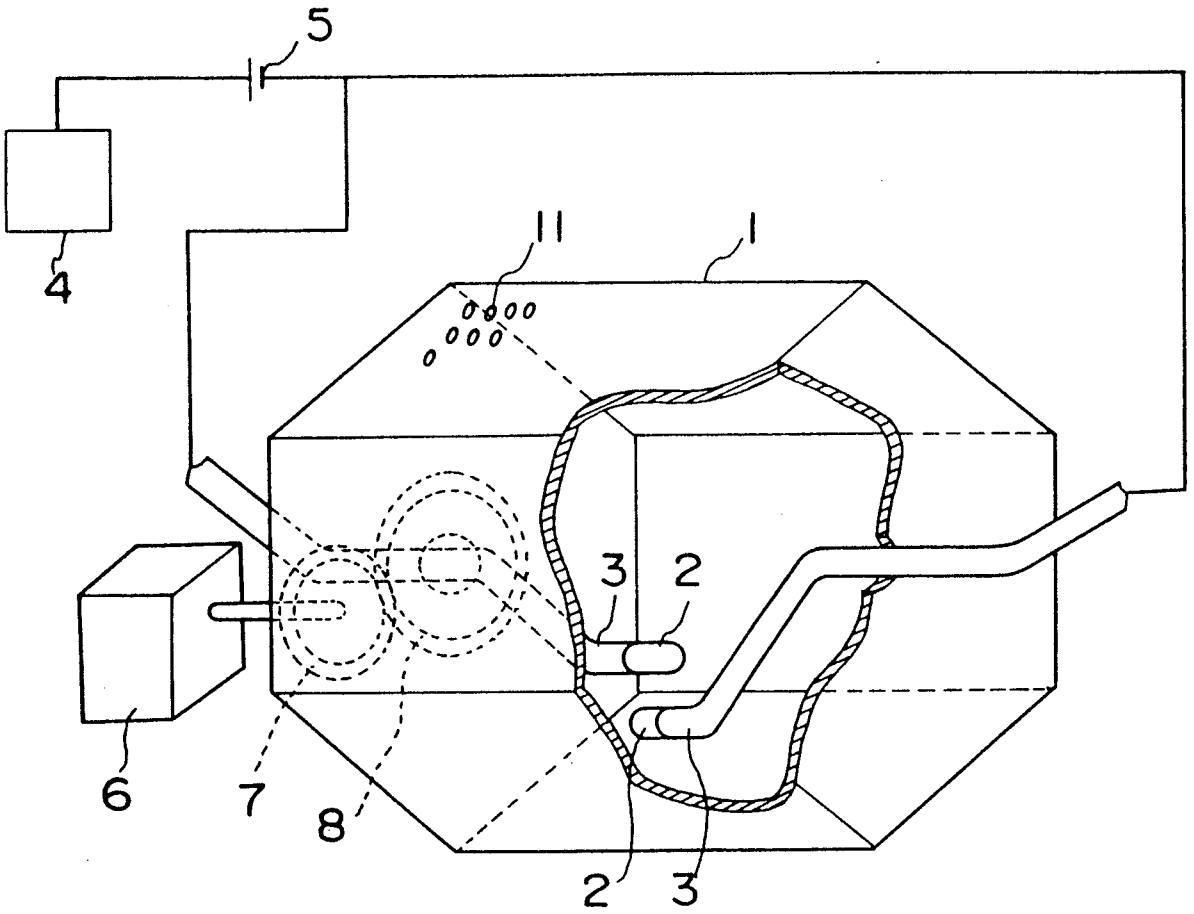
FIG. 1 is a schematic perspective view of a conventional barrel type electroplating apparatus used for carrying out this invention.

A bonded magnet is porous in both of its surface and inner portions. Moreover, its surface has portions in which a magnetic powder is exposed, and portions in which a binder, such as a synthetic resin, is exposed. Its surface, therefore, lacks uniformity in electrical resistance. These factors make it difficult to form a metal coating of good oxidation and corrosion resistance having few pinholes and adhering closely to the surface of a bonded magnet without lowering its magnetic properties. These problems and difficulty can all be overcome by the special plating method of this invention which is suitable for application to the bonded magnets. The following is a description of preferred embodiments of this invention, including a comparison of bonded magnets having metal coatings formed on their surfaces by a conventional method, and bonded magnet having metal coatings formed on their surfaces by methods embodying this invention, from which the effectiveness of this invention is believed to become apparent.

First Embodiment

As a result of our research efforts, we, the inventors of this invention, have found that the problems as indicated above can be overcome by employing an aqueous solution which contains an organic acid salt instead of the chloride conventionally used in an aqueous solution for nickel electroplating, and which has an appropriately controlled pH value.

According to a first aspect of this invention, therefore, it resides in a method of plating a bonded magnet which comprises electroplating a bonded magnet in an aqueous solution consisting mainly of nickel sulfate, an electrolyte in the form of an organic acid salt not containing chlorine, and a basic electrolyte not containing chlorine, and having a pH of 5 or above to form a nickel coating on its surface.

The aqueous solution has a pH of 5 or above, preferably of 6 or above, and more preferably from 6 to 8. If the solution has a pH of less than 5, it is likely to corrode the surface of the material to be plated (i.e. a bonded magnet), or penetrate it to cause the corrosion of its surface and inner portions, and therefore, fails to achieve any effective nickel plating. This is a problem which can occur to, among others, a bonded magnet made by molding a mixture of a magnetic metal powder and a synthetic resin. This is apparently due to the porous surface of a bonded magnet, particularly one made by compression molding. If the solution has a pH of at least 5, but less than 6, the above problem does not occur, but the material to be plated is likely to have an oxidized surface. Such oxidation is likely to lower to some extent the magnetic properties of, for example, a bonded magnet made by employing a magnetic metal powder.

If an ordinary aqueous solution for nickel plating has a pH in excess of 7, its quality is greatly lowered by the nickel hydroxide which is formed therein. The aqueous solution used for the purpose of this invention is, however, allowed to have a pH up to 8 due to the formation of a complex by the metal ions of an organic acid salt and the buffering action of an additive, as will hereinafter be described. The use of any solution having a pH in excess of 8 is, however, undesirable, since it is likely to form a nickel coating not adhering closely to the surface of the base material. Although no definite reason for this tendency is known as yet, it is probable that a passive film may be formed on the surface of the material in an alkaline solution having a pH in excess of 8.

The aqueous solution is preferably of the nature which exhibits a buffering action against any undesirable change of pH. The solution is likely to change its pH and have a pH deviating from the preferred range during the process of nickel electroplating. Although this problem may be overcome by measuring the pH of the solution from time to time during the plating operation and adding an appropriate amount of a basic or acidic electrolyte to it, this method is not desirable from an industrial standpoint. If the solution is of the nature which exhibits a buffering action, it is advantageously possible to eliminate, or at least reduce, the trouble of measuring its pH and adding a basic or acidic electrolyte to it. An aqueous solution usually has the nature of exhibiting a buffering action if it contains a weak acid or base, and a salt thereof. Examples of the substances which can be used to prepare a buffer solution are potassium hydrogen phthalate, sodium hydroxide, sodium secondary citrate, potassium primary phosphate, sodium secondary phosphate, borax, collidine, lactic acid, sodium lactate, citric acid, potassium primary citrate, sodium acetate, acetic acid, Veronal sodium, trisaminomethane, sodium carbonate and boric acid. In view of the objects of this invention, it is certainly undesirable to use any chloride. Boric acid is the most preferable additive to be used to prepare a buffer solution. A solution containing boric acid has been found to be capable of forming a coating having good properties, including hardness and corrosion resistance, and boric acid is easily available on an industrial basis and is inexpensive.

The addition of an alkali, or alkaline earth metal salt as an electrolyte to the aqueous solution is desirable to impart a still better corrosion resistance to the material which has been plated. This is a fact found by experience, and nothing definite is known as yet about the mechanism which explains it. The following is, therefore, an explanation based on our assumption. If no such metal salt is added, the nickel ions in the aqueous solution are electrically reduced and deposited on the surface of the material to be plated, thereby increasing the concentration of sulfuric acid anions on and near the surface of the material to be plated, and the sulfuric acid anions stay in the surface and inner portions of the plated material and lower its corrosion resistance. If any such metal salt is added, however, it is assumed that the cations of an alkali, or alkaline earth metal cover the surface of the material to be plated, and prevent any sulfuric acid anion from contacting it. Sodium sulfate is an example of the metal salts which can be employed.

Examples of the organic acid salts which can be employed for the purpose of this invention are Rochelle salt, citrates, oxalates and sulfamates. Although these salts are good substitutes for chlorides, some of them cause a slight reduction in magnetic properties of a bonded magnet during its plating. In this connection, and also from the standpoints of industrial availability and economy, it is particularly desirable to use Rochelle salt, or sodium or ammonium citrate.

Examples of the basic electrolytes which can be employed for the purpose of this invention are sodium hydroxide, potassium hydroxide, magnesium hydroxide and ammonia water, which are all in common use.

The aqueous solution preferably has a temperature of 20° C. to 30° C. If it has a temperature which is lower than 20° C., there occurs a reduction in the rate of electrode reaction, or nickel deposition, resulting in a lower efficiency. If it has a temperature which is higher than 30° C., the material to be plated is likely to crack or chip, if it is low in strength, and if the apparatus used for plating it is of the barrel, or other type that causes an impact force to act upon it. This is particularly the case with a bonded magnet.

It is also desirable to add magnesium or aluminum sulfate to the aqueous solution. These sulfates increase the toughness of a nickel coating and resist any change that impurities may cause to the physical properties of the coating. They are preferably added in the amount of 40 to 70 g per liter of the solution. The addition of too small an amount fails to produce any satisfactory increase in toughness, and the addition of too large an amount results in a nickel coating which is not satisfactorily lustrous.

The aqueous solution may further contain a lustering agent, a leveling agent and a satinizing agent. Cobalt sulfate may be a preferred lustering agent for a nickel coating, though it is also possible to use, for example, sodium 1,5-naphthalenedisulfonate, paratoluenesulfoneamide, saccharin, toluene, xylene or toluidine as the lustering agent. Formaldehyde, thiourea, 1,4-butanediol, coumarin and propargyl alcohol are examples of the leveling agent which can be employed.

It is desirable to use a nickel material containing sulfur as the anode in a plating apparatus. The use of a commercially available nickel electrode, or nickel material in chip or block form containing 1 to 8% by weight of sulfur is, among others, preferred from the standpoints of industrial availability and economy. If the nickel material used as the anode contains sulfur, it enables a higher plating efficiency than when it does not. This is apparently due to the fact that sulfur promotes the dissolution of nickel in the aqueous solution, though nothing further is known. The use of any nickel electrode containing too much sulfur is, however, undesirable, as it results in the formation of a nickel coating containing sulfur as impurity.

The use of a barrel type electroplating apparatus is preferred for plating a relatively small part. A barrel type electroplating apparatus and an electroplating process which is carried out by employing it will now be described by way of example with reference to the drawings.

The apparatus is schematically shown in FIG. 1, and includes a barrel 1 made usually of plastics and having holes 11 all over its wall, in which cathodes 2 each having a covered portion 3 are inserted. The barrel 1 is rotatable by a motor 6 of which the rotation is transmitted to it through gears 7 and 8. The cathodes 2 and an anode 4 are connected to a DC power source 5, as shown, whereby an electric circuit is formed. The materials to be plated are put in the barrel 1, the whole apparatus, except the DC power source 5, or the DC power source 5 and the motor 6, is immersed in an electrolyte, and a voltage is applied between the cathodes 2 and the anode 4, while the motor is placed in operation. The barrel 1 is usually charged with a large quantity of materials to be plated, since the individual materials are very small as compared with the volume of the barrel 1.

The rotation of the barrel 1 causes the materials to move round, while forming a fluidized layer on their surfaces, and as they contact the cathodes directly, or contact the other materials that have contacted the cathodes, they acquire an electric potential over the anode and cations of a metal in the solution are deposited on the surfaces of the materials.

The method of this invention may be used for electroplating either the surface of a magnet directly, or an electrically conductive undercoating formed thereon. If the magnet surface is directly electroplated, it is desirable to clean beforehand the surface to be plated. More specifically, it is desirable to clean the surface, for example, by a physical method such as shot blasting, or barrel polishing, which will hereinafter be described, or by a chemical method employing an acid, or other activating agent, or by washing with water or a solvent. An electrically conductive undercoating can be formed by, for example, metal or alloy vapor deposition, electroless plating, coating with a mixture of an electrically conductive powder and a resin, mechanical plating, or powder coating. After the materials have been plated, it is desirable to wash them, and close the pinholes in the coating formed thereon.

The following is a description in further detail of the invention in which bonded magnets having metal coatings formed on their surfaces in accordance with this invention (samples of this invention) will be compared with a bonded magnet having a metal coating formed on its surface in accordance with the conventional practice (comparative sample). It is, however, to be understood that the following description is not intended for limiting the scope of this invention.

Bonded magnets having surfaces which were porous and relatively high in electrical resistance were used as the materials to be plated, so that the advantages of this invention might be more clearly distinguished over the prior art. Certain details of the magnet samples are shown in Table 1.

TABLE 1

| Samples of bonded magnets | |
|---|---|
| Metal powder | Nd—Fe—B magnetic alloy powder |
| Binder | Phenolic resin |
| Molding method | Compression molding at normal temperature using a pressure of |

TABLE 1-continued

| Samples of bonded magnets | |
|---|---|
| | 5 tons/cm$^2$ |
| Volume resistivity | $1.2 \times 10^{-2}$ ohm · cm |
| Shape of molded magnet | 8 mm dia. × 6 mm dia. × 4 mm h. |

The samples were put in the barrel type electroplating apparatus shown in FIG. 1 to make Comparative Sample 1 and Samples 1 to 3 of this invention. The samples were plated under the conditions shown in Table 2, using aqueous solutions having different compositions as shown in Tables 3 to 6. It will be noted that Comparative Sample 1 was made by plating in an ordinary solution having a high sulfate content.

TABLE 2

| Common plating conditions | |
|---|---|
| Quantity of solution | 100 liters |
| Voltage (current) | 5 V (about 10 A) |
| Nickel coating thickness | About 30 microns |
| Number of materials plated | 300 |

Note:
The anode and the materials to be plated had a ratio of 2 to 1 in surface area.

TABLE 3

| Aqueous solution used for Comparative Sample 1 | |
|---|---|
| Composition | Amount (g/liter) |
| Nickel sulfate | 120 |
| Sodium sulfate | 100 |
| Ammonium chloride | 20 |
| Boric acid | 20 |
| pH | 6.5 |
| Temperature | 25° C. |

TABLE 4

| Aqueous solution used for Sample 1 of this invention | |
|---|---|
| Composition | Amount (g/liter) |
| Nickel sulfate | 70 |
| Sodium sulfate | 65 |
| Sodium citrate | 25 |
| Boric acid | 15 |
| Magnesium sulfate | 25 |
| Cobalt sulfate | 5 |
| Sodium hydroxide | As required for pH control |
| pH | 6.5 |
| Temperature | 25° C. |

TABLE 5

| Aqueous solution used for Sample 2 of this invention | |
|---|---|
| Composition | Amount (g/liter) |
| Nickel sulfate | 80 |
| Sodium sulfate | 65 |
| Ammonium citrate | 25 |
| Boric acid | 15 |
| Aluminum sulfate | 65 |
| Cobalt sulfate | 5 |
| Sodium hydroxide | As required for pH control |
| pH | 6.5 |
| Temperature | 25° C. |

TABLE 6

| Aqueous solution used for Sample 3 of this invention | |
|---|---|
| Composition | Amount (g/liter) |
| Nickel sulfate | 100 |
| Sodium sulfate | 70 |
| Rochelle salt | 20 |
| Boric acid | 15 |
| Ammonia water | As required for pH control |
| pH | 6.5 |
| Temperature | 25° C. |

The samples prepared as hereinabove described were left to stand at a temperature of 80° C. and a relative humidity of 95% for 300 hours for evaluation as to moisture resistance, and were examined with the naked eye for the rusting of their surfaces. The results are shown in Table 7.

TABLE 7

| Results of moisture resistance tests | |
|---|---|
| Sample | Results |
| Comparative Sample 1 | All of the materials tested were very rusty. |
| Sample 1 of the invention | No rust was found. |
| Sample 2 of the invention | No rust was found. |
| Sample 3 of the invention | No rust was found. |

These results confirm that the method of this invention can form a good metal coating on not only an ordinary metallic part, but also a part having a porous surface, such as a bonded magnet, and impart a practically perfect level of corrosion resistance to any such part.

Second Embodiment

According to a second aspect of this invention, it resides in a method of plating a bonded magnet which comprises barrel polishing a bonded magnet instead of cleansing it with any strong acid such as chromic or sulfuric acid, and electroplating it to form a metal coating on its surface.

Barrel polishing is a dry or wet method. Wet barrel polishing is performed in a solvent such as water or an organic solvent, while no such solvent is used for dry barrel polishing.

Barrel polishing is usually carried out by rotating, vibrating, or otherwise moving a vessel which contains a large quantity of materials to be polished, and which may further contain an abrasive and a solvent, if required. The movement of the vessel causes the collision of the materials against one another, or against the abrasive which enables the removal of any contaminant from the materials and thereby the exposure of a clean and active surface on each material. The polished surface has fine projections and concavities which provide an anchor effect enabling a coating to adhere closely to the surface. There are barrel polishing apparatus of, for example, the rotary, centrifugal and vibratory types.

Ceramic or metal particles can, for example, be used as the abrasive. The shape, volume, surface roughness and amount of the abrasive to be used depend on the shape, volume, amount and hardness of the materials to be polished. It is desirable to use a material which is harder than the materials to be polished. The use of the abrasive is effective for accelerating polishing, and for controlling the surface roughness of the materials to be polished. The abrasive may also be a mixture of different materials, or materials having different shapes or sizes. It may also be a mixture of a hard abrasive and an abrasive which is softer than the materials to be polished, such as a plastic, or wood meal.

The use of the solvent is effective for preventing any contaminant from adhering again to the materials which have been polished. If water is used as the solvent, it may be necessary to neutralize it or make it weakly alkaline, and bubble an inert gas into it to reduce dissolved oxygen, in order to prevent the oxidation and corrosion of the magnet surfaces to be polished. The addition of a surface active agent is effective for achieving an improved result of cleansing.

The method of this invention can be used to form a coating of a metal such as Zn, Sn, Cu, Ni, Au, Ag or Pb. It can also be used to form a coating of an alloy consisting mainly of any such metal. A plating solution may contain a pH controller, a lustering agent, a leveling agent, a satinizing agent, etc., as required. The method is otherwise equal to that which has hereinbefore been described as the first embodiment of this invention, and no further description thereof is, therefore, made.

The following is a description in which bonded magnets plated in accordance with this invention will be compared with ones plated in accordance with the conventional practice. It is, however, to be understood that the following description is not intended for limiting the scope of this invention.

The bonded magnets which had been made by the compression molding of a Nd-Fe-B alloy and had porous surfaces liable to corrosion were used as the materials to be plated, so that the advantages of this invention might be more clearly distinguished over the prior art. Table 8 shows details of the magnet samples which were employed.

TABLE 8

| Samples of bonded magnets | |
|---|---|
| Metal powder | Nd—Fe—B magnetic alloy powder |
| Binder | Phenolic resin |
| Molding method | Compression molding at normal temperature using a pressure of 5 tons/cm$^2$ |
| Volume resistivity | $1.2 \times 10^{-2}$ ohm · cm |
| Shape of molded magnet | 8 mm dia. × 6 mm dia. × 4 mm h. |

TABLE 9

| Conditions for the dip cleansing of Comparative Samples | | |
|---|---|---|
| Sample | Solution composition | Dipping time (min.) |
| 2 | Not cleansed | 0 |
| 3 | 0.5% acid ammonium fluoride | 10 |
| 4 | 2% sulfuric acid | 2 |
| 5 | 0.5% nitric acid | 2 |
| 6 | 0.5% hydrochloric acid | 2 |

TABLE 10

| Conditions for the barrel polishing of Samples of this invention | | | |
|---|---|---|---|
| Sample | Abrasive | Solvent | Time (min.) |
| 4 | None | None (dry method) | 15 |
| 5 | 8 mm dia. ceramic balls | None (dry method) | 10 |
| 6 | 3 mm dia. ceramic balls | Pure water (wet method) | 12 |

A rotary barrel polishing apparatus was employed. Its barrel had a capacity of 101 liters, and was charged with 31 liters of the materials to be polished (Sample 4), or of the materials to be polished and the abrasive (Sample 5 or 6). The materials to be polished and the abrasive had a ratio by volume of 3 to 1. The barrel was rotated at a speed of 12 rpm. Table 11 shows the magnetic properties as pretreated of Comparative Samples 2 to 6 and Samples 4 to 6 of this invention.

TABLE 11

| Magnetic properties as pretreated | | |
|---|---|---|
| Sample | Maximum energy product (MGOe) | Coercive force (Oe) |
| Comparative | | |
| 2 | 8.9 | 9.2 |
| 3 | 8.7 | 8.9 |
| 4 | 8.6 | 8.8 |
| 5 | 8.7 | 8.9 |
| 6 | 8.6 | 8.9 |
| Invention | | |
| 4 | 8.9 | 9.2 |
| 5 | 8.9 | 9.2 |
| 6 | 8.9 | 9.2 |

The samples which had been pretreated were all electroplated under the same conditions, and the electroplated samples were evaluated by visual inspection, a crosscut tape peeling test, and 400 hours of a moisture resistance test at 80° C. and a relative humidity of 95%. The electroplating conditions are shown in Tables 12 and 13.

TABLE 12

| Electroplating conditions (1) | |
|---|---|
| Quantity of a bath | 100 liters |
| Voltage (current) | 5 V (about 10 A) |
| Nickel coating thickness | About 30 microns |
| Number of magnets plated | 300 |

Note:
The anode and the materials to be plated had a ratio of 2 to 1 in surface area.

TABLE 13

| Electroplating conditions (2) | |
|---|---|
| Composition | Amount (g/liter) |
| Nickel sulfate | 120 |
| Sodium sulfate | 65 |
| Sodium citrate | 25 |
| Boric acid | 15 |
| Magnesium sulfate | 25 |
| Cobalt sulfate | 5 |
| Sodium hydroxide | As required for pH control |
| pH | 6.5 |
| Bath temperature | 25° C. |

The results of evaluation are shown in Table 14.

TABLE 14

| Results of evaluation | | | |
|---|---|---|---|
| Sample | Visual inspection | Peeling test | Moisture resistance test |
| Comparative | | | |
| 2 | Bulgy surface | 10/100 | Rusty |
| 3 | Good | 5/100 | Rusty |
| 4 | Good | 8/100 | Very rusty |
| 5 | Good | 8/100 | Very rusty |
| 6 | Good | 7/100 | Very rusty |
| Invention | | | |
| 4 | Good | 0/100 | Not rusty |
| 5 | Good | 0/100 | Not rusty |
| 6 | Good | 0/100 | Not rusty |

In Table 14, the result of the peeling test is shown by the number of crosscut portions of coating which peeled off, out of a total of 100, by adhering to a tape.

These results confirm that the method of this invention can form a metal coating of good adhesive strength and corrosion resistance on a bonded magnet without lowering its magnetic properties, and is particularly effective for plating a porous alloy magnet which is liable to corrosion by an acid.

Third Embodiment

According to a third or fourth aspect of this invention, it resides in a method of plating a bonded magnet which comprises coating the surface of a bonded magnet with a mixture of a resin and a powder of an electrically conductive material, and electroplating the magnet to form a metal coating on its surface, or a method which comprises forming a metal coating by electroplating on the surface of a bonded magnet made by molding a magnetic powder wit a mixture of a resin and a powder of an electrically conductive material, or a metal powder, as a binder. The "coating the surface of a bonded magnet with a mixture of a resin and a powder of an electrically conductive material" means forming a film of the mixture on the magnet surface. This film can be formed by employing any of a variety of methods, such as spray, dip, or powder coating.

Examples of the metal which can be used for electroplating a bonded magnet are Ni, Cu, Cr, Fe, Zn, Cd, Sn, Pb, Al, Au, Ag, Pd, Pt and Rh. It is also possible to use an alloy consisting mainly of any such metal. The aqueous electroplating solution which can be used depends on the metal, or anode metal used. Examples of the bath which can be used are a copper cyanide bath, a copper pyrophosphate bath, a copper sulfate bath, a bath for forming a dull nickel coating, a Watts bath, a sulfamic acid bath, a wood's strike bath, an immersion nickel bath, a hexavalent chromium bath having a low concentration, a hexavalent chromium sargent's bath, a chromium hexafluoride bath, a high-oxidation state alkali cyanide bath for zinc plating, a medium-oxidation state alkali cyanide bath for zinc plating, a low-oxidation state alkali cyanide bath for zinc plating, a cadmium cyanide bath, a cadmium borofluoride bath, a sulfuric acid bath for tin plating, a borofluoric acid bath for tin plating, a borofluoric acid bath for lead plating, a sulfamic acid bath for lead plating, a methanesulfonic acid bath for lead plating, a borofluoric acid solder bath, a phenolsulfonic acid solder bath, an alkanolsulfonic acid solder bath, a chloride bath for iron plating, a sulfate bath for iron plating, a borofluoride bath for iron plating, a sulfamate bath for iron plating, a stannate bath for Sn-Co alloy plating, a pyrophosphoric acid bath for Sn-Co alloy plating, a fluoride bath for Sn-Co alloy plating, a pyrophosphoric acid bath for Sn-Ni alloy plating, and a fluoride bath for Sn-Ni alloy plating. The bath may contain various additives such as a lustering agent, a leveling agent, an agent for preventing the formation of pits, a satinizing agent, an anode dissolving agent, a pH buffer agent, and a stabilizer. The direct electroless plating of a magnet surface may be preceded by pretreatment, such as cleansing and surface activation, or barrel polishing as hereinbefore described. Every electroless plating operation may be followed by posttreatment including rinsing with cold or hot water, and sealing, as required.

The method of this invention is particularly effective for plating a bonded rare-earth magnet. Insofar as a bonded rare-earth magnet is liable to rusting as hereinbefore stated, it is definitely desirable from the standpoint of corrosion resistance to use an electroplating bath having a pH as close as possible to the neutral, and as low a chlorine content as possible.

The bonded rare-earth magnet is a molded product of a mixture of a magnetic powder represented as R-T-B (where R stands for Nd, or a mixture of Nd and another rare-earth element, and T stands for Fe, or a mixture of Fe and a transition element), and a synthetic resin as a binder. It can be made by, for example, compression, injection, extrusion or calender molding.

Thermosetting resins including phenolic, epoxy and melamine resins, and thermoplastic resins including polyamides such as nylon 6 and nylon 12, polyolefins such as polyethylene and polypropylene, polyvinyl chloride, polyester and polyphenylene sulfide are examples of the resin which is mixed with a powder of an electrically conductive material to form a mixture for coating the surface of a bonded magnet, or a binder for a magnetic powder.

The powder of an electrically conductive material may, for example, be of aluminum, silver, nickel or copper, or of carbon. Its particle shape and diameter are so selected as to satisfy dispersibility and other requirements. It is effective to treat the powder with a coupling, or surface-active agent to promote its dispersion in the resin. It is also possible to add to the resin a substance which can improve the dispersibility of the powder.

It is desirable that a film of the mixture of a resin and a powder of an electrically conductive material be formed on a clean and smooth magnet surface. If the magnet surface is contaminated with water, oil, etc., or covered with an oxide film, the film of the mixture fails to adhere closely to the magnet surface, and disables the formation of a metal coating having the desired corrosion resistance. If the magnet surface is very low in smoothness, and full of uneven portions or pinholes, it is very difficult to coat it with a uniform film. The pinholes can present a particularly difficult problem. If they are not closed completely, it is likely not only that a corrosive substance may penetrate the film and cause it to peel off, but also that when the magnet surface is plated, the plating solution may penetrate it, stay in the magnet and cause its corrosion. A clean surface can be obtained by, for example, a chemical method such as washing with water or a solvent, or surface treatment with an acid or other activating agent, or a physical method such as grinding, shot blasting or barrel polishing. A smooth surface can be obtained by, for example, grinding or barrel polishing. A rotary, centrifugal or vibratory barrel can, for example, be employed for barrel polishing. Barrel polishing can be performed either by a wet process using an abrasive solution, or by a dry process not using any such abrasive, as hereinbefore described in connection with the second embodiment of this invention. If, nevertheless, a film containing a powder of an electrically conductive material still fails to adhere satisfactorily to the magnet surface, or if pinholes still exist, it is effective to perform the dry barrel polishing of the film when it is relatively soft. The striking force of the polishing medium acting upon the magnet surface causes the film to be partly pressed into the concavities in the magnet surface and thereby improve its adhesion thereto, while closing the pinholes in the film, whereby a uniform film having few defects can be obtained. If the barrel is charged with the resin and powder used for coating a magnet, it is possible to accomplish simultaneously the coating of the magnet and the formation of a film adhering closely to it and having its pinholes closed, and thereby achieve a simplified process and an improved corrosion resistance.

The metal powder which can be used as a binder may, for example, be of zinc, tin or lead. It is only for compression molding that a metal can be used as a binder. It is important for any binder used in compression molding to be deformable under pressure to improve the density of a molded product. It is, therefore, desirable to use a relatively soft metal, and a metal having a low melting point. In view of their low melting points, it is also possible to use, for example, a Rose's, Newton's, Wood's or Powitz' alloy.

The method of this invention is preferably employed for electroplating a bonded magnet with nickel or an alloy thereof, for the reason as hereinbefore stated.

The electroplating of a bonded magnet can be preceded by its electroless plating. Electroless plating is based on the principle that the electrons which are released by a reducing agent upon oxidation cause metal ions in a solution to be deposited as a metal on the material to be plated. It has the advantages of, among others, enabling the formation of a coating having a uniform thickness, and the coating of even the interior of pores, and being inexpensive to carry out by using a simple and inexpensive apparatus. As is obvious from its principle stated above, electroless plating enables substantially the uniform deposition of metal on both a magnetic powder and a synthetic resin, and is, therefore, most suitable for the purpose of this invention. It is applicable either onto the magnet surface directly, or onto an undercoating formed from a mixture of a resin and a powder of an electrically conductive material. A variety of undercoatings formed from other materials are also useful for improving the adhesion of a coating formed by electroless plating, and preventing the formation of pinholes therein.

The solution which can be used for electroless plating depends on the metal used to form a coating. A wide variety of baths having different compositions are, therefore, available. Specific examples are a copper plating bath containing copper sulfate and some of Rochelle salt, formaldehyde, sodium carbonate, sodium hydroxide, EDTA, sodium cyanide, etc.; a nickel or nickel-alloy plating bath containing nickel sulfate or nickel chloride or a mixture thereof and some of sodium acetate, lactic acid, sodium citrate, sodium hypophosphite, boric acid, ammonium sulfate, ammonium chloride, ethylenediamine, ammonium citrate, sodium pyrophosphate, etc.; a cobalt or cobalt-alloy plating bath containing cobalt sulfate and some of sodium hypophosphite, sodium citrate, sodium tartrate, ammonium sulfate, boric acid, etc.; a gold plating bath containing potassium dicyanoaurate(I) or potassium tetracyanoaurate(III) or a mixture thereof and some of potassium cyanide, potassium hydroxide, lead chloride, potassium boron hydride, etc.; a silver plating bath containing silver cyanide and some of sodium cyanide, sodium hydroxide, dimethylamineborane, thiourea, etc.; a palladium plating bath containing palladium chloride and some of ammonium hydroxide, ammonium chloride, sodium ethylenediaminetetraacetate, sodium phosphinate, hydrazine, etc.; and a tin plating bath containing tin chloride and some of sodium citrate, sodium ethylenediaminetetraacetate, sodium nitrotriacetate, titanium trichloride, sodium acetate, benzenesulfonic acid, etc. Any such bath may further contain additives such as a lustering agent, a leveling agent, an agent for preventing pit corrosion, a satinizing agent, a pH buffer agent, a stabilizer and a complex-forming agent. The electroless plating which is employed for the purpose of this invention may be accompanied by pretreatment and posttreatment. The pretreatment includes the steps of, for example, degreasing by dipping, electrolysis or a solvent, acid, alkali or palladium treatment, and rinsing with water, while the posttreatment includes the steps of, for example, chromating and rinsing with cold or hot water.

The metal or alloy with which the material to be plated is coated by electroless plating is selected from among, for example, copper, nickel, cobalt, tin, silver, gold and platinum, or Ni-Co, Ni-Co-B, Ni-Co-P, Ni-Fe-P, Ni-W-P, Ni-P, Co-Fe-P, Co-W-P and Co-Ni-Mn-Re alloys. It is desirable for the electroless plating bath to have a pH as close to the neutral as possible, and as low a chlorine content as possible, for the same reason as has been stated in connection with electroplating.

More specifically, the aqueous solution which is used for electroless plating has a pH of 5 or above, preferably of 6 or above, and more preferably from 6 to 10. If its pH is below 5, it is likely that the solution may corrode the surface of a bonded magnet during its plating, or may penetrate the magnet, stay therein and corrode its surface or inner portion. Its plating is, therefore, of no use. If the solution has a pH of at least 5, no such problem may occur, but if its pH is below 6, it is likely that the pole surfaces of the magnet may be deteriorated by oxidation. Such oxidation tends to bring about a slight lessening in magnetic properties of the bonded rare-earth magnet. If the solution has a pH above 10, it is likely to form a nickel coating failing to adhere closely to the magnet surface. This is probably due to the formation of a passive film on the magnet surface in a strongly alkaline environment, though nothing further is known.

It is desirable for the solution to exhibit a buffer action against any undesirable change of pH. The solution is likely to have a change of pH during the progress of a plating operation despite the fact that its pH has a critical bearing on the objects of this invention. Although this problem can be overcome by measuring the pH of the solution from time to time and adding an appropriate amount of a pH controller to it whenever necessary, this is not a method which can be recommended from the standpoint of industrial efficiency. If the solution has a buffer action, it is advantageously possible to eliminate, or at least reduce the trouble of measuring its pH and adding the pH controller. The solution has a buffer action, if it contains an appropriate amount of a weak acid or base and a salt thereof. Examples of the buffer agent are potassium hydrogen phthalate, sodium hydroxide, sodium secondary citrate, potassium primary phosphate, sodium secondary phosphate, borax, collidine, lactic acid, sodium lactate, citric acid, potassium primary citrate, sodium acetate, acetic acid, Veronal sodium, trisaminomethane, sodium carbonate and boric acid. In view of the objects of this invention, it is definitely desirable not to use any chloride.

It is desirable that the principal element of the metal used for electroless plating be equal to that of the metal used for electroplating. This is desirable to ensure that a layer formed by electroless plating and a layer formed by electroplating adhere closely to each other, and that no sacrificial corrosion occur from any difference in standard electrode potential, or corrosion potential between the two layers.

The material to be plated by the method of this invention is a bonded magnet, and a part which utilizes its magnetic force. The magnetic force which can be utilized has an unavoidable reduction with an increase in thickness of a coating formed on the magnet. Although a smaller coating thickness enables a more effective use of the magnetic force, it is necessary to select the coating thickness suited for the purpose for which the material to be plated is used, since its reduction brings about a reduction of corrosion resistance contrary to the objects of this invention. It is, therefore, desirable that the resin coating, electroplating or electroless plating, and electroplating which are formed by the method of this invention have a total thickness of 5 to 100 microns.

The following is a further description in which bonded magnets having metal coatings formed by the method of this invention will be compared with comparative ones having metal coatings formed in accordance with the conventional practice. It is, however, to be understood that the following description is not intended for limiting the scope of this invention.

Bonded Nd-Fe-B magnets having porous surfaces liable to rust were used as the materials to be plated, so that the advantages of this invention might be more clearly distinguished over the prior art. Tables 15 to 17 show details of the samples.

TABLE 15

| | Sample A |
|---|---|
| Magnetic metal powder | Nd—Fe—B magnetic alloy powder |
| Binder | Phenolic resin |
| Molding method | Compression molding at normal temperature using a pressure of 5 tons/cm$^2$ |
| Shape of molded magnet | 8 mm dia. × 6 mm dia. × 4 mm h. |

TABLE 16

| | Sample B |
|---|---|
| Magnetic metal powder | Nd—Fe—B magnetic alloy powder |
| Binder | Resin containing a powder of an electrically conductive material, see Table 19 |
| Molding method | Compression molding at normal temperature using a pressure of 5 tons/cm$^2$ |
| Shape of molded magnet | 8 mm dia. × 6 mm dia. × 4 mm h. |

TABLE 17

| | Sample C |
|---|---|
| Magnetic metal powder | Nd—Fe—B magnetic alloy powder |
| Binder | Wood's alloy powder |
| Molding method | Compression molding at normal temperature using a pressure of 8 tons/cm$^2$ |
| Shape of molded magnet | 8 mm dia. × 6 mm dia. × 4 mm h. |

TABLE 18

| | | Surface treatment | | |
|---|---|---|---|---|
| Sample | Category (see Tables 15 to 17) | Coating of mixture of resin and electrically conductive material | Electroless plating | Electroplating |
| Comparative | A | Not done | Not done | Done |
| 7 | | | | |
| Invention | | | | |
| 7 | A | Not done | Done | Done |
| 8 | A | Done | Not done | Done |

TABLE 18-continued

| | | Surface treatment | | |
|---|---|---|---|---|
| Sample | Category (see Tables 15 to 17) | Coating of mixture of resin and electrically conductive material | Electroless plating | Electroplating |
| 9 | B | Not done | Not done | Done |
| 10 | C | Not done | Not done | Done |

Tables 19 to 21 show the composition of the mixture of a resin and an electrically conductive material, the conditions of electroless plating, and the conditions of electroplating, respectively. The mixture was applied by spray coating.

Each sample was so prepared as to have a total coating thickness of 30 microns including a thickness of about five microns for a coating of the mixture of a resin and an electrically conductive material and a thickness of about five microns for a coating formed by electroless plating.

TABLE 19

| Composition of mixture of a resin and an electrically conductive material | |
|---|---|
| Phenolic resin | 30% by weight |
| Nickel powder having an average particle diameter of 1 micron | 70% by weight |

TABLE 20

| Conditions of electroless plating | |
|---|---|
| Composition | Amount (g/liter) |
| Nickel hypophosphite | 26.7 |
| Sodium sulfate | 4.9 |
| Boric acid | 12.0 |
| Ammonium sulfate | 2.6 |
| pH | 5.5 to 6.0 |
| Temperature | 21° C. |
| Method | Dipping |

TABLE 21

| Conditions of electroplating | |
|---|---|
| Composition | Amount (g/liter) |
| Nickel sulfate | 70 |
| Sodium sulfate | 65 |
| Sodium citrate | 25 |
| Boric acid | 15 |
| Magnesium sulfate | 25 |
| Cobalt sulfate | 5 |
| Sodium hydroxide | As required for pH control |
| pH | 6.5 |
| Temperature | 25° C. |
| Apparatus | Barrel type |

The samples were left to stand at a temperature of 80° C. and a relative humidity of 90% for 600 hours, and were visually examined for rusting. The results are shown in Table 22.

TABLE 22

| Results of visual examination | |
|---|---|
| Sample | Results |
| Comparative | Macroscopically rusty |
| 7 | |
| Invention | |
| 7 | Not rusty |
| 8 | Microscopically rusty |
| 9 | Microscopically rusty |
| 10 | Microscopically rusty with a bulgy |

TABLE 22-continued

| Sample | Results of visual examination Results |
|---|---|
| | coating |

The results confirm that the method of this invention can electroplate a bonded rare-earth magnet to impart to it so high a level of corrosion resistance as has hitherto been impossible.

Fourth Embodiment

Still another aspect of this invention is a method of plating a bonded magnet which comprises coating a bonded rare-earth magnet with a resin or nonmetallic inorganic material for its pretreatment against any penetration and residence of a plating solution therein, and plating the magnet electrolessly with a solution having a pH of 5 or above and a low chlorine content to form a metal coating on its surface.

The bonded rare-earth magnet and electroless plating solution which were employed for carrying out the method under description were the same as those which had been described in connection with the third embodiment of this invention. No repeated description is, therefore, made.

The resin which is used for the pretreatment of the magnet surface may be any of common thermoplastic or thermosetting resins, and may, for example, be any of the synthetic resins which have hereinbefore been listed as binder resins. It is, however, preferable to use a resin having a chelating and/or reducing power. The resin having a chelating power adheres closely to the material to be coated, and the resin having a reducing power can keep a reducing condition on the surface of the material to be plated, and thereby improve its corrosion resistance. Examples of the resins having a chelating and/or reducing power are common thermosetting resins modified with polyhydric phenols, and mixtures of common thermosetting resins and polyhydric phenols. More specific examples are polycondensation products of tannic acid, phenols and aldehydes, and epoxy resins modified with polyhydric phenols.

Water glass and ceramics are examples of the nonmetallic inorganic material which is used for the pretreatment of the magnet surface. It is, however, possible to use any other material, too, if it is suitable for the purpose of this invention.

The pretreatment can, for example, be carried out by dipping or spraying, and can be followed by, for example, drying and curing under heat, if required.

Although copper, nickel, cobalt, tin, silver, gold and platinum, or alloys thereof can generally be employed for electroless plating as hereinbefore stated, nickel or cobalt or an alloy thereof is definitely more effective and desirable than any other metal or alloy, for the reason which has hereinbefore been stated. Moreover, we have found that a somewhat higher level of corrosion resistance can be achieved by cobalt or cobalt-alloy plating than by nickel or nickel alloy plating.

It is desirable to employ for electroless plating an aqueous solution having a temperature of 20° C. to 50° C. If its temperature is lower than 20° C., the rate of reaction, or metal deposition is too low to be acceptable from the standpoint of industrial efficiency. If its temperature is over 50° C., the bonded magnet to be plated is likely to swell with the solution, and eventually crack or chip.

The following is a listing by way of example of the preferred composition of an aqueous solution for electroless plating not containing chlorine, which is mainly responsible for the corrosion of a plated material, and having a pH of 6 to 10:

(1) Nickel sulfate, at lest one of ammonium citrate and sodium citrate, and sodium hypophosphite;
(2) Nickel sulfate, at least one of ammonium citrate and sodium citrate, sodium hypophosphite and lactic acid;
(3) Nickel sulfate, at least one of ammonium citrate and sodium citrate, lactic acid, thioglycollic acid and dimethylamineborane;
(4) Nickel hypophosphite, sodium acetate, boric acid and ammonium sulfate; or
(5) Cobalt sulfate, sodium hypophosphite and sodium citrate.

It is possible to eliminate the pretreatment of the magnet surface with a resin or nonmetallic inorganic material and yet attain the object of promoting the deposition of metal by electroless plating if the magnet surface is so treated as to have a catalytic action. This catalytic action can be obtained by palladium treatment, or dipping in a solution consisting mainly of Ag ions.

The palladium treatment usually consists of two stages:

(1) The material to be treated is dipped in a solution containing 20 to 40 g of $SnCl_2.2H_2O$ and 10 to 20 ml of conc. HCl per liter at normal temperature for a period of one to three minutes, and is thereafter rinsed with water; and
(2) Then, it is dipped in a solution containing 0.1 to 0.6 g of $PdCl.2H_2O$ and 1 to 5 ml of conc. HCl per liter at normal temperature for a period of two to five minutes.

The two stages of treatment cause the following reaction to take place on the surface of the material to be treated, whereby metallic palladium having a high catalytic action is deposited on the surface of the material and promotes the deposition of metal by a reducing action during electroless plating:

$$Sn^{2+} + Pd^{2+} \rightarrow Sn^{4+} + Pd^{0}$$

The palladium treatment as hereinabove described is, however, not recommended for the material to be plated in accordance with this invention, since the solutions which it employs contain chlorides, and are acidic. We have, therefore, developed an improved method which includes dipping the material to be treated in a solution consisting mainly of Ag ions to catalyze its surface, and which comprises two stages of treatment:

(1) The material to be treated is dipped in a solution containing 9 to 10 g of $AgNO_3$ and about 5 ml of ammonia water (or a sufficient amount of ammonia water to form a transparent solution) per liter for a period of one to two minutes; and
(2) Then, it is dipped in a solution containing 18 to 20 g of hydrazine sulfate and 4 to 5 g of sodium hydroxide per liter for a period of one to two minutes.

This treatment causes silver having a high catalytic action to be deposited on the material and eventually promote the deposition of metal during electroless plating. The solutions are alkaline and do not contain chlorine, and therefore make it possible to overcome the problems caused by the treatment known in the art as hereinabove described. It is to be understood that the solutions have been shown above merely by way of example.

The following is a further description in which magnet samples plated in accordance with this invention will be compared with ones plated in accordance with the conventional practice. It is, however, to be understood that the following description is not intended for limiting the scope of this invention.

The samples were bonded Nd-Fe-B magnets having porous surfaces liable to rust, so that the advantages of this invention might be more clearly distinguished over the prior art. They are equal to the samples shown in Table 15 appearing in the foregoing description of the third embodiment of this invention.

The samples were electrolessly plated by using the solutions shown in Tables 23 to 30 to provide Comparative Samples 8 and 9 and Samples 11 to 16 of this invention. The plating time was selected to form a metal coating having a thickness of 10 microns on every sample.

TABLE 23

| Aqueous solution used for Comparative Sample 8 | |
|---|---|
| Composition | Amount (g/liter) |
| Nickel chloride | 30 |
| Sodium hypophosphite | 10 |
| Sodium hydroxyacetate | 50 |
| pH | 4 |
| Temperature | 90° C. |

TABLE 24

| Aqueous solution used for Comparative Sample 9 | |
|---|---|
| Composition | Amount (g/liter) |
| Nickel chloride | 16 |
| Sodium hypophosphite | 24 |
| Sodium succinate | 16 |
| Malic acid | 18 |
| pH | 5.6 |
| Temperature | 100° C. |

TABLE 25

| Aqueous solution used for Sample 11 of this invention | |
|---|---|
| Composition | Amount (g/liter) |
| Nickel sulfate | 53 |
| Ammonium citrate | 97 |
| Sodium hypophosphite | 106 |
| pH | 10 |
| Temperature | 30° C. |

TABLE 26

| Aqueous solution used for Sample 12 of this invention | |
|---|---|
| Composition | Amount (g/liter) |
| Sodium hypophosphite | 26.7 |
| Sodium acetate | 4.9 |
| Boric acid | 12.0 |
| Ammonium sulfate | 2.6 |
| pH | 5.5 to 6.0 |
| Temperature | 21° C. |

TABLE 27

| Aqueous solution used for Sample 13 of this invention | |
|---|---|
| Composition | Amount (g/liter) |
| Nickel acetate | 50 |
| Sodium citrate | 25 |
| Lactic acid | 25 |
| Thioglycollic acid | 1.5 |
| Dimethylamineborane | 2.5 |
| pH | 7 |
| Temperature | 21° C. |

TABLE 28

| Aqueous solution used for Sample 14 of this invention | |
|---|---|
| Composition | Amount (g/liter) |
| Nickel acetate | 15 |
| Sodium citrate | 35 |
| Lactic acid | 2 ml/liter |
| Sodium hypophosphite | 10 |
| pH | 8.0 |
| Temperature | 40° C. |

TABLE 29

| Aqueous solution used for Sample 15 of this invention | |
|---|---|
| Composition | Amount (g/liter) |
| Copper sulfate | 15 |
| Rochelle salt | 40 |
| Paraformaldehyde | 10 |
| Thiourea | 1 mg/liter |
| pH | 12.5 |
| Temperature | 21° C. |

TABLE 30

| Aqueous solution used for Sample 16 of this invention | |
|---|---|
| Composition | Amount (g/liter) |
| Cobalt sulfate | 0.1 |
| Sodium hypophosphite | 0.2 |
| Sodium citrate | 0.5 |
| pH | 7 |
| Temperature | 90° C. |

The samples were left to stand at a temperature of 80° C. and a relative humidity of 95% for 200 hours for evaluation on moisture resistance, and were visually examined for rusting. The results are shown in Table 31.

TABLE 31

| Results of visual examination | |
|---|---|
| Sample | Results |
| Comparative | |
| 8 | So rusty as to lose its original shape |
| 9 | Very rusty |
| Invention | |
| 11 | Not rusty |
| 12 | Not rusty |
| 13 | Not rusty |
| 14 | Not rusty |
| 15 | Rusty in spots |
| 16 | Not rusty |

These results confirm that the method of this invention can form a closely adherent metal coating giving corrosion resistance to a bonded rare-earth magnet having a porous surface.

Fifth Embodiment

Description will now be made of improvements in the barrel type electroplating apparatus shown in FIG. 1. Although the apparatus shown in FIG. 1 has been found to be capable of forming a metal coating on the surface of a bonded magnet by using a specific aqueous solution, it has also been found that, if the material to be plated has a circular or square cylindrical shape, the metal coating formed thereon has a great difference in thickness between the inner and outer surfaces of the material, and is likely to develop pinholes, lack uniformity in luster, and crack. Although it is true that the porous surface of a bonded magnet is greatly responsible for the formation of pinholes in the metal coating, the construction of the apparatus has also not a small bearing on this problem.

We have studied the possible cause of the problem and will describe our conclusion which we have derived from the results of our study. It is mostly in the outer surfaces thereof that the materials to be plated contact the cathodes, or the other materials contacting the cathodes, while it is very rare that the materials contact the electrodes directly. It is, therefore, obvious that metal cations are more likely to be deposited as metal on the outer surfaces of the materials than on the inner surfaces thereof if they have a circular or square cylindrical shape, and insofar as it is very rare that they contact the cathodes directly, it is apparently for only a very short period of time that a sufficiently large amount of electric current is supplied to their inner surfaces. These conclusions coincide with the fact that a metal coating formed on a material having a high volume resistivity has a great difference in thickness between its inner and outer surfaces.

As far as the materials contacting the cathodes directly are concerned, however, it is apparent that a large amount of electric current is consumed on the surface of each such material and causes metal cations to be rapidly deposited as metal thereon. It is obvious that the rapid deposition of metal is likely to form a coating lacking uniformity and result in the formation of pinholes. It is also apparent that the rapid formation of hydrogen and other gases accompanying the rapid reducing reaction of metal cations is also responsible for the formation of pinholes. Although this problem can be overcome by, for example, the use of a lower current or voltage, a longer period of time is required for a plating operation and makes it impossible to achieve any high operating efficiency that is desired from an industrial standpoint.

An electric current flows from the cathodes to the materials to be plated as soon as they contact the cathodes, but as it is mostly in spots that the materials contact the cathodes, the current has a very high density. It is apparent that the current density is so high as to cause local seizure, and that the local seizure deprives the metal coating of its uniformity in luster.

We have also found that cracking is caused by impact when the materials to be plated strike against the cathodes. In this connection, it is to be noted that it is impossible to rotate the barrel at a higher speed to ensure that all of the materials to be plated have an even chance of contacting the cathodes directly.

We have finally arrived at the conclusion that it is important to give the materials to be plated greater opportunities of contacting the cathodes and thereby realize the uniform distribution of an electric current to the materials to be plated. We have developed two improved forms of barrel type electroplating apparatus to realize our conclusion, as will hereinafter be described.

Figure 2:
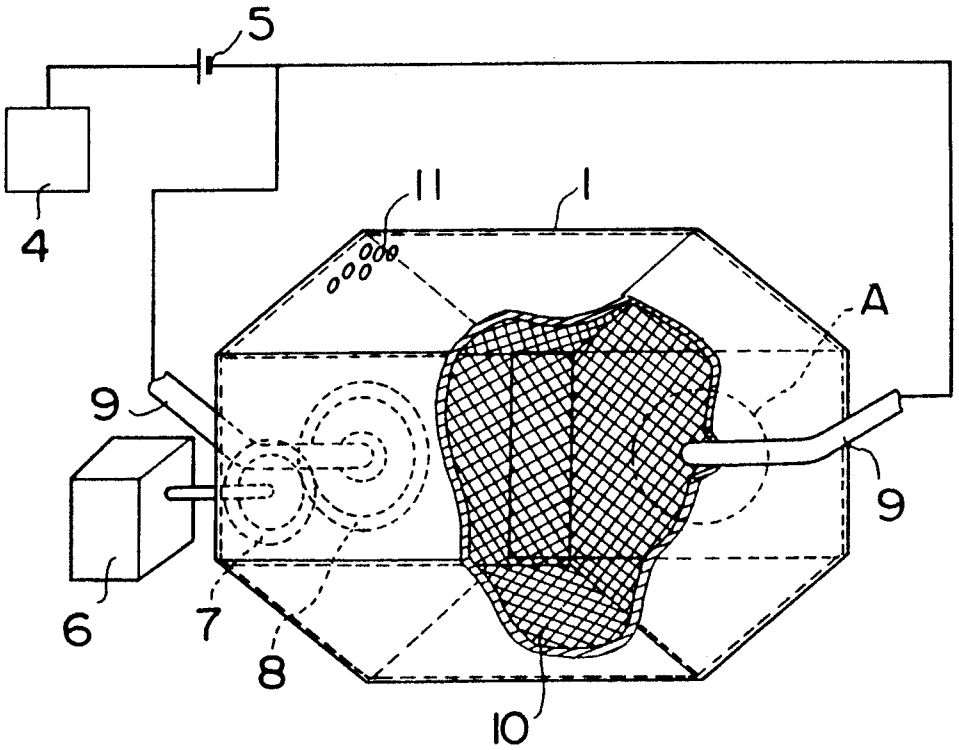
FIG. 2 is a schematic perspective view of an improved barrel type electroplating apparatus used for carrying out this invention.

Reference is first made to FIG. 2 showing a barrel type electroplating apparatus including a cathode in the form of a wire net. Numerals 1, 4 to 8 and 11 denote like parts in both FIGS. 1 and 2, and no repeated description thereof is, therefore, made. The cathode 10 in the form of a wire net is provided on the inner surface of the barrel 1. The material of the wire net, its wire diameter, the size of its mesh openings and the method of making it depend on the materials to be plated, their shape and the conditions employed for plating them. The mesh openings need be sufficiently large not to obstruct the passage of the solution, or the diffusion and electrophoresis of cations. This is also a factor having a significant bearing on the size and shape of the holes 11 made in the wall of the barrel 1.

The wire net is made of an electrically conductive material which is not dissolved in the electrolyte. It is usually made of a metal or alloy. Stainless steel is, among others, preferred for the reason which will now be explained. Some anode metal or alloy is deposited on the wire net during the process of plating, and its removal is effected by dipping the wire net in an acid, or reversing the polarity of the DC power source 5. The surfaces of the wire net from which the deposited metal has been removed are passive and are not dissolved, if the wire net is of stainless steel.

Figure 3:
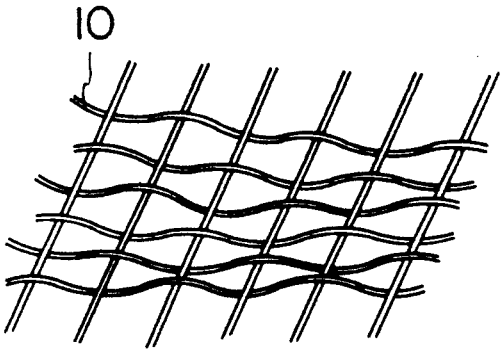
FIG. 3 is a perspective view of a wire net used as a cathode.
Figure 4:
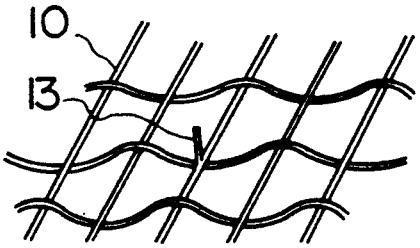
FIG. 4 is a perspective view of a wire net having a projection.
Figure 5A:
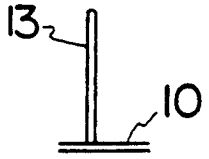
FIGS. 5(*a*) to 5(*e*) are a set of side elevational views showing different forms of projections on a wire net, i.e. 5(*a*) is a straight projection, 5(*b*) is an angled or bent projection, 5(*c*) is a U-shaped projection, 5(*d*) is a J-shaped projection, and 5(*e*) is a P-shaped projection.
Figure 5B:
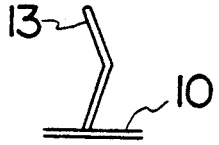
Figure 5C:
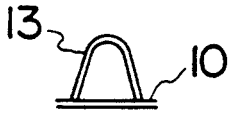
Figure 5D:
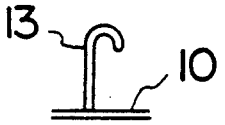
Figure 5E:
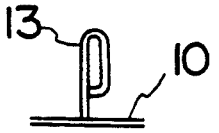

Although the wire net may be of any common form as shown in FIG. 3, it preferably has a projection 13 as shown in FIG. 4. The projection 13 is of an electrically conductive material and is provided for contacting the inner surface of a circular or square cylindrical material to be plated, and thereby supplying an electric current to it. The size, shape, position and number of the projections 13 depend on the shape, size and number of the materials to be plated, and the rotating speed of the barrel 1. Several different shapes of projections 13 are shown by way of example in FIGS. 5(*a*) to 5(*e*). They are (*a*) a straight projection, (*b*) an angled or bent projection, (*c*) a U-shaped projection, (*d*) a J-shaped projection, and (*e*) a P-shaped projection, respectively.

Figure 6:
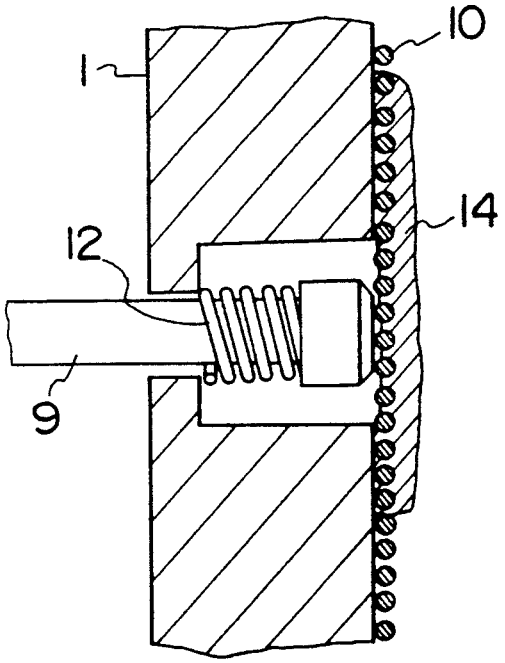
FIG. 6 is an enlarged view, partly in section, of part A of FIG. 2 showing a device for supplying an electric current to a wire net.

An arrangement for supplying an electric current to the wire net 10 is shown by way of example in FIG. 6. FIG. 6 is an enlarged view of part A of FIG. 2. A partly cladded feed cable 9 is pressed against the wire net 10 by a spring 12 to establish electrical contact with it. That portion of the wire net 10 which is located near the end of the cable 9 may be coated with an insulator 14, such as a resin, since ions of the anode metal are particularly liable to deposition on that portion.

Bonded magnets having a cylindrical shape and a relatively high electrical resistance were plated as samples to ascertain the advantages of the apparatus. Details of the samples are shown in Table 32.

TABLE 32

| Samples of bonded magnets | |
|---|---|
| Metal powder | Magnetic Sm—Co alloy powder |
| Binder | Phenolic resin |
| Molding method | Compression molding at normal temperature using a pressure of 5 tons/cm$^2$ |
| Volume resistivity | $1.2 \times 10^{-2}$ ohm-cm |
| Shape | 8 mm dia. × 6 mm dia. × 4 mm h. |

A set of 300 samples were plated by the conventional apparatus shown in FIG. 1 to make Comparative Sample 10, and another set of 300 samples by the improved apparatus shown in FIG. 2, and having a wire net of the form shown in FIG. 3 to make Sample 17 of this invention. The thickness of the metal coating which had been formed on each magnet was measured to give a ratio in coating thickness between the outer and inner surfaces thereof. Each magnet was examined for pinholes and traces of seizure through a microscope of 20 magnifications. The conditions employed for plating the magnets are shown in Table 33, details of the apparatus in Table 34, and the results of evaluation in Table 35.

TABLE 33

| Plating conditions | |
|---|---|
| Composition of bath solution (g/liter): | |
| Nickel sulfate | 240 |
| Nickel chloride | 50 |
| Boric acid | 30 |
| Additives | Appropriate amounts |
| Amount of solution | 100 liters |
| pH | 3.5 to 5.5 |
| Voltage (current) | 5 V (about 10 A) |
| Temperature | 57° C. |
| Time | 60 min. |
| Barrel rotating speed | 6 rpm |

Note:
The anode and the materials to be plated had a ratio of 2 to 1 in surface area.

TABLE 34

| Plating apparatus | |
|---|---|
| Barrel | |
| Material | Acrylic resin |
| Hole diameter | 3 mm |
| Total hole area | 20% of the total barrel surface |
| Wire net | |
| Wire diameter | 0.5 mm |
| Mesh size | 5 mm |

TABLE 35

| | Results of evaluation | |
|---|---|---|
| Item | Comparative Sample 10 | Sample 17 of the invention |
| Ratio in thickness of outer surface coating to inner surface coating | 2.1 | 1.3 |
| Number of pinholes | Medium | Small |
| Traces of seizure | A few | None |
| Number of cracked materials | 15 | None |

Note:
The ratio is based on the average value of coating thicknesses which were determined by the measurement by a micrometer of the difference in dimensions between the material to be plated and the material as plated.

These results confirm that the improved apparatus enables the uniform distribution of an electric current to the materials to be plated, and thereby the formation on every material of a coating having only a small difference in thickness between its outer and inner surfaces, and substantially free from pinholes, and any unevenness in color due to seizure, while the wire net used as the cathode can prevent any cracking of the materials to be plated. The apparatus is particularly useful for plating materials having a relatively high electrical resistance, such as products of powder metallurgy, and compression molded products.

Another improved form of barrel type electroplating apparatus has a barrel which is charged with both the materials to be plated and an electrically conductive material. It is important for the electrically conductive material to have an electrical resistance which is lower at least one its surface than the materials to be plated, and to be movable in the barrel with the materials to be plated. It is, therefore, desirable for the material to have at least a surface composed of a metal and/or an alloy, such as nickel, iron, copper, chromium or cobalt. It is also important for the material to have a specific gravity which is approximately equal to that of the materials to be plated, and which is preferably within plus or minus 30% of the latter, so that it may be movable in the barrel with the materials to be plated. If its specific gravity is over 30% higher, it is very likely to move separately from the materials to be plated, which brings about a result contrary to the objects of this invention. These requirements can be met by, for example, using as the electrically conductive material what is obtained by forming a metal coating on the material to be plated. This is probably the best way to satisfy the requirements. The metal coating can be formed by, for example, dry plating, dip coating, or wet electroplating or electroless plating.

The optimum shape, volume and quantity of the electrically conductive materials to be used depend on the amount of the electrolyte, the volume of the barrel, the quantity, strength, shape and volume of the materials to be plated, and the voltage-current conditions employed. It is particularly important from the standpoint of operating efficiency to avoid the use of any quantity of materials making a total volume which is twice or more as large as that of the materials to be plated, since most of the electric current which is supplied is, then, consumed on the surfaces of the electrically conductive materials. It is possible to use two or more kinds of electrically conductive materials which differ in composition, shape or volume.

Examples of the anode metal or alloy which can be employed are Ni, Cu, Cr, Fe, Zn, Cd, Sn, Pb, Al, Au, Ag, Pd, Pt and Rh, or alloys thereof, or mixtures thereof.

Bonded magnets having a relatively high electrical resistance and are relatively liable to crack were plated as samples to ascertain the advantages of the improved apparatus. They were as shown in Table 32.

A set of magnets were plated in the conventional apparatus shown in FIG. 1 to make Comparative Samples 11 to 13, and another set of magnets were plated in the improved apparatus charged also with the electrically conductive materials shown in Table 36 to make Samples 18 and 19 of this invention. The plating conditions which were employed are shown in Tables 37 to 39.

The outside diameters of the samples as plated were measured by a micrometer, and their standard deviation was used as a measure of uniformity in coating thickness. The samples as plated were also examined for cracking or chipping. The results are shown in Table 40.

TABLE 36

| | Electrically conductive materials | |
|---|---|---|
| Symbol | A | B |
| Material | 18-8 stainless steel | Material to be plated on which a copper coating having a thickness of about 30 microns was formed by electroless plating |

TABLE 36-continued

| Symbol | Electrically conductive materials A | B |
|---|---|---|
| Shape | 8 mm dia. ball | 8 mm dia. × 6 mm dia. 4 mm h. |
| Number used | 300 | 300 |

TABLE 37

| Plating conditions | |
|---|---|
| Composition of bath solution (g/liter): | |
| Nickel sulfate | 240 |
| Nickel chloride | 50 |
| Boric acid | 30 |
| Additives | Appropriate amounts |
| Amount of solution | 100 liters |
| pH | 3.5 to 5.5 |
| Voltage (current) | 5 V (about 10 A) |
| Temperature | 57° C. |
| Time | 60 min. |
| Number of samples | 300 |

Note:
The anode and the materials to be plated had a ratio of 2 to 1 in surface area.

TABLE 38

| Plating apparatus (1) | |
|---|---|
| Barrel | |
| Material | Acrylic resin |
| Hole diameter | 3 mm |
| Total hole area | 20% |

TABLE 39

| Sample | Plating apparatus (2) Electrically conductive material | Rotating speed of barrel (rpm) |
|---|---|---|
| Comparative | | |
| 11 | Not used | 6 |
| 12 | Not used | 15 |
| 13 | Not used | 30 |
| Invention | | |
| 18 | A | 6 |
| 19 | B | 6 |

TABLE 40

| Sample | Results of evaluation Standard deviation | Cracking (%) | Chipping (%) |
|---|---|---|---|
| Comparative | | | |
| 11 | 15 microns | 0 | 0 |
| 12 | 9 microns | 1 | 4 |
| 13 | 5 microns | 3 | 15 |
| Invention | | | |
| 18 | 4 microns | 0 | 0 |
| 19 | 5 microns | 0 | 0 |

These results confirm that the improved apparatus enables the uniform distribution of an electric current to the materials to be plated, and thereby the formation of uniform metal coatings having only a small difference in thickness, even if the barrel is rotated at a low speed.

What is claimed is:

1. A method of manufacturing a bonded magnet which comprises mixing and molding a powder of a magnetic material represented as R-T-B, where R stands for Nd or a mixture of Nd and another rare-earth element, and T stands for Fe or a mixture of Fe and a transition element, and a binder to form the bonded magnet; coating the magnet with a mixture of a resin and a powder of an electrically conductive material, and electroplating the coated magnet to form a metal coating thereon.

2. A method as set forth in claim 1, wherein said metal coating is formed from an aqueous solution consisting mainly of nickel sulfate, an electrolyte in the form of an organic acid salt not containing chlorine, and a basic electrolyte not containing chlorine, and having a pH of at least 5.

3. A method of manufacturing a bonded magnet which comprises mixing and molding a powder of a magnetic material represented as R-T-B, where R stands for Nd or a mixture of Nd and another rare-earth element, and T stands for Fe or a mixture of Fe and a transition element, with a resin and a powder of an electrically conductive material to form the bonded magnet, and electroplating the bonded magnet to form a metal coating thereon.

4. A method as set forth in claim 3, wherein said metal coating is formed from a aqueous solution consisting mainly of nickel sulfate, an electrolyte in the form of an organic acid salt not containing chlorine, and a basic electrolyte not containing chlorine, and having a pH of at least 5.

5. A method of manufacturing a bonded magnet which comprises mixing and molding a powder of a magnetic material represented as R-T-B, where R stands for Nd or a mixture of Nd and another rare-earth element, and T stands for Fe or a mixture of Fe and a transition element, with a binder consisting of a metal powder to form the bonded magnet, and electroplating the bonded magnet to form a metal coating thereon.

6. A method as set forth in claim 5, wherein said metal coating is formed from an aqueous solution consisting mainly of nickel sulfate, an electrolyte in the form of an organic acid salt not containing chlorine, and a basic electrolyte not containing chlorine, and having a pH of at least 5.

7. A coated bonded magnet comprising magnetic powder held together by a binder to form a bonded magnet and a plated, substantially pinhole-free nickel coating formed on the surface of the bonded magnet, wherein the nickel coating is formed at a pH of at least 5 and is substantially free of chlorine atoms or chloride ions.

8. A coated bonded magnet as set forth in claim 7, further comprising a coating composition interposed between the bonded magnet and the plated nickel coating, the coating composition comprising a resin and an electrically conductive powder.

9. A coated bonded magnet as set forth in claim 7, wherein the bonded magnet further comprises an electrically conductive powder.

10. A coated bonded magnet as set forth in claim 7, wherein the binder is a metal.

* * * * *